US009670648B2

(12) United States Patent
Kanniappan et al.

(10) Patent No.: US 9,670,648 B2
(45) Date of Patent: Jun. 6, 2017

(54) REPLACEABLE TIP SYSTEMS FOR A TINE

(71) Applicant: Caterpillar Inc., Peoria, IL (US)

(72) Inventors: Gopalakrishnan Kanniappan, Tamil Nadu (IN); Gregory Seljestad, Wamego, KS (US); Kadirvel Muthusamy, Tamil Nadu (IN); Venkatesh Madeshi, Tamil Nadu (IN); Ashok Rajendran, Tamil Nadu (IN); Anuop Udayakumar, Tamil Nadu (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/822,190

(22) Filed: Aug. 10, 2015

(65) Prior Publication Data

US 2017/0044739 A1 Feb. 16, 2017

(51) Int. Cl.
*E02F 9/28* (2006.01)
*B66F 9/12* (2006.01)

(52) U.S. Cl.
CPC ..... *E02F 9/2808* (2013.01); *B66F 9/12* (2013.01); *E02F 9/2816* (2013.01); *E02F 9/2833* (2013.01); *E02F 9/2875* (2013.01)

(58) Field of Classification Search
CPC ..... A01B 13/10; A01B 15/025; A01B 35/20; A01B 35/14; A01B 61/042; A01C 5/062; E02F 9/2875; E02F 9/2825; E02F 9/2833; E02F 9/2841; E02F 9/2858; E02F 9/2883; E02F 9/2808; E02F 9/2816; B66F 9/12
USPC ..... 37/446, 452–460; 172/699, 701.1–701.3, 172/705, 724, 732, 730, 139, 140, 196
See application file for complete search history.

(56) References Cited

U.S. PATENT DOCUMENTS

| | | | |
|---|---|---|---|
| 1,303,770 | A | 5/1919 | Carr |
| 1,375,638 | A | 4/1921 | Kienzle |
| 1,544,222 | A | 6/1925 | Crosby |
| 2,305,653 | A | 12/1942 | Ward |
| 2,450,044 | A | 9/1948 | Hobbs |
| 2,546,457 | A | 3/1951 | Launder et al. |
| 2,807,105 | A | 9/1957 | Launder |
| 2,870,552 | A | 1/1959 | Richardson |
| 2,895,559 | A | 7/1959 | Toland |
| 2,996,291 | A | 8/1961 | Krekeler |
| 3,013,620 | A | 12/1961 | Hill |
| 3,177,037 | A | 4/1965 | Elders |

(Continued)

FOREIGN PATENT DOCUMENTS

| | | |
|---|---|---|
| AU | 542726 B2 | 3/1985 |
| AU | 573942 B2 | 6/1988 |

(Continued)

*Primary Examiner* — Robert Pezzuto
(74) *Attorney, Agent, or Firm* — Baker Hostetler; Law Office of Kurt J. Fugman LLC

(57) ABSTRACT

A breaker tine comprises a front elongated portion, a rear elongated portion, a nose portion extending from the front elongated portion at an opposite end from the rear elongated portion, and a replaceable ground engaging tool coupled to the nose portion of the breaker tine. The breaker tine may include pins for attaching the ground engaging tool to the breaker tine. The breaker tine may further include a first receiving cavity formed in a first side of the nose portion, and a second receiving cavity formed in a second side of the nose portion, wherein the first receiving cavity is opposite the second receiving cavity but do not communicate or connect with each other.

13 Claims, 12 Drawing Sheets

(56) References Cited

U.S. PATENT DOCUMENTS

| | | | | |
|---|---|---|---|---|
| 3,292,281 | A | 12/1966 | Petersen | |
| 3,330,601 | A | 7/1967 | Proctor | |
| 3,334,431 | A | 8/1967 | Phillips | |
| 3,344,488 | A | 10/1967 | Texier | |
| 3,345,765 | A | 10/1967 | Petersen | |
| 3,388,488 | A | 6/1968 | Duplessis | |
| 3,397,012 | A | 8/1968 | Krekeler | |
| 3,426,459 | A | 2/1969 | Petersen | |
| 3,469,332 | A | 9/1969 | Leffingwell | |
| 3,601,911 | A | 8/1971 | Wood | |
| 3,643,296 | A | 2/1972 | Kahn | |
| 3,685,177 | A | 8/1972 | Hahn et al. | |
| 3,767,266 | A | 10/1973 | Krekler | |
| 3,864,854 | A | 2/1975 | Evans | |
| 3,865,437 | A | 2/1975 | Crosby | |
| 3,952,433 | A | 4/1976 | Heinold et al. | |
| 3,997,989 | A | 12/1976 | Stepe | |
| 4,210,374 | A | 7/1980 | Churla | |
| 4,231,173 | A | 11/1980 | Davis | |
| 4,320,924 | A | 3/1982 | Langfield et al. | |
| 4,335,532 | A | 6/1982 | Hahn et al. | |
| 4,349,232 | A | 9/1982 | Braun et al. | |
| 4,367,602 | A | 1/1983 | Petersen | |
| 4,404,760 | A | 9/1983 | Hahn et al. | |
| 4,414,764 | A | 11/1983 | Johansson et al. | |
| 4,501,079 | A | 2/1985 | Hahn et al. | |
| 4,505,058 | A | 3/1985 | Peterson | |
| 4,641,868 | A | 2/1987 | Miron | |
| 4,716,666 | A | 1/1988 | Potter | |
| 4,881,331 | A | 11/1989 | Paizes | |
| 5,005,304 | A | 4/1991 | Briscoe et al. | |
| 5,149,152 | A | 9/1992 | Lanius | |
| 5,221,176 | A | 6/1993 | Allen et al. | |
| 5,241,765 | A | 9/1993 | Jones et al. | |
| 5,596,908 | A | 1/1997 | Hall | |
| 5,605,382 | A | 2/1997 | Massa | |
| 5,666,748 | A | 9/1997 | Emrich et al. | |
| 5,709,043 | A | 1/1998 | Jones et al. | |
| 5,718,070 | A | 2/1998 | Ruvang | |
| 5,913,605 | A | 6/1999 | Jusselin et al. | |
| 5,918,391 | A | 7/1999 | Vinas Peya | |
| 5,966,849 | A | 10/1999 | Moehnke et al. | |
| 6,030,143 | A | 2/2000 | Kreitzberg | |
| 6,047,487 | A | 4/2000 | Clendenning | |
| 6,108,950 | A | 8/2000 | Ruvang et al. | |
| 6,119,378 | A | 9/2000 | Pippins | |
| 6,230,676 | B1 | 5/2001 | Pryba et al. | |
| 6,430,851 | B1 | 8/2002 | Clendenning | |
| 6,471,465 | B2 | 10/2002 | Albertyn | |
| 6,708,431 | B2 | 3/2004 | Robinson et al. | |
| 6,871,426 | B2 | 3/2005 | Keech et al. | |
| 6,938,961 | B2 | 9/2005 | Broom | |
| 7,162,818 | B2 | 1/2007 | Ruvang et al. | |
| 7,178,274 | B2 | 2/2007 | Emrich | |
| 7,640,684 | B2 | 1/2010 | Adamic et al. | |
| 7,762,015 | B2 * | 7/2010 | Smith | E02F 9/2825 37/455 |
| 7,882,649 | B2 | 2/2011 | Carpenter et al. | |
| 8,122,621 | B2 | 2/2012 | Carpenter et al. | |
| RE43,693 | E | 10/2012 | Emrich | |
| 8,689,472 | B2 | 4/2014 | Carpenter et al. | |
| 2002/0000053 | A1 | 1/2002 | Adamic et al. | |
| 2003/0037936 | A1 | 2/2003 | Skjaeveland | |
| 2003/0101627 | A1 * | 6/2003 | Robinson | E02F 9/2825 37/456 |
| 2005/0173203 | A1 | 8/2005 | Buckner | |
| 2005/0229442 | A1 | 10/2005 | Jones et al. | |
| 2007/0116547 | A1 | 5/2007 | Bulkeley | |
| 2008/0256832 | A1 | 10/2008 | Esti | |
| 2008/0310946 | A1 | 12/2008 | Allen | |
| 2014/0259808 | A1 | 9/2014 | LaHood et al. | |
| 2014/0352182 | A1 | 12/2014 | LaHood et al. | |

FOREIGN PATENT DOCUMENTS

| | | | |
|---|---|---|---|
| AU | 642377 | B | 10/1993 |
| AU | 716828 | B2 | 6/1997 |
| AU | 716600 | B2 | 4/1998 |
| AU | 718560 | B2 | 2/2000 |
| AU | 773435 | B2 | 6/2001 |
| AU | 2004200257 | A1 | 2/2004 |
| CA | 907661 | A | 8/1972 |
| CA | 2076019 | A1 | 7/1992 |
| CA | 2305617 | A1 | 5/1999 |
| CA | 2358932 | A1 | 4/2002 |
| CA | 2598209 | A1 | 6/2003 |
| CA | 2443169 | A1 | 10/2004 |
| CA | 2520002 | A1 | 11/2004 |
| CA | 2555794 | A1 | 10/2005 |
| DE | 2052149 | A1 | 11/1971 |
| DE | 2419831 | A1 | 11/1975 |
| DE | 3720924 | A1 | 1/1989 |
| EP | 0739854 | A1 | 10/1996 |
| EP | 1174547 | A1 | 1/2002 |
| EP | 1584600 | A1 | 10/2005 |
| FR | 2298650 | A1 | 8/1976 |
| GB | 392773 | | 5/1933 |
| GB | 647746 | | 12/1950 |
| GB | 678382 | | 9/1952 |
| GB | 896384 | | 5/1962 |
| GB | 939370 | | 10/1963 |
| GB | 952216 | | 3/1964 |
| GB | 971547 | | 9/1964 |
| GB | 988419 | | 4/1965 |
| GB | 996691 | | 6/1965 |
| GB | 1011165 | | 11/1965 |
| GB | 1033376 | | 6/1966 |
| GB | 1042877 | | 9/1966 |
| GB | 1215839 | | 12/1970 |
| GB | 1327953 | | 8/1973 |
| GB | 1410814 | | 10/1975 |
| GB | 1486549 | | 9/1977 |
| GB | 1557152 | | 12/1979 |
| GB | 2105388 | A | 3/1983 |
| GB | 2118616 | A | 11/1983 |
| JP | 4828802 | | 4/1973 |
| JP | 4863501 | | 8/1973 |
| JP | 48108403 | | 12/1973 |
| JP | 4993502 | | 8/1974 |
| JP | 5011602 | | 4/1975 |
| JP | 5015361 | | 5/1975 |
| JP | 5142859 | A | 4/1976 |
| JP | 53137501 | A | 12/1978 |
| JP | 5492271 | | 6/1979 |
| JP | 558715 | | 1/1980 |
| JP | 5550200 | | 4/1980 |
| JP | 56167096 | A | 12/1981 |
| JP | 61216941 | A | 9/1986 |
| JP | 61225430 | A | 10/1986 |
| JP | 61261598 | | 10/1986 |
| JP | 63-1068 | A | 1/1988 |
| JP | 6393935 | A | 4/1988 |
| JP | 63142131 | A | 6/1988 |
| JP | 02502033 | | 7/1988 |
| JP | 57009932 | A | 1/1989 |
| JP | 3-122139 | A | 5/1991 |
| JP | 4-213632 | A | 8/1992 |
| JP | 10-102548 | A | 4/1998 |
| JP | 10-252106 | A | 9/1998 |
| JP | 11-107329 | A | 4/1999 |
| JP | 2006069719 | A | 3/2006 |
| JP | 2000-31943 | A | 11/2011 |
| KR | 10-2013-0137842 | A | 12/2013 |
| WO | 8805483 | A1 | 7/1988 |
| WO | 2007060697 | A1 | 5/2007 |

* cited by examiner

REPLACEABLE TIP SYSTEMS FOR A TINE

TECHNICAL FIELD

This patent disclosure relates generally to a machine accessory and, more particularly, to a replaceable tip for a breaker tine.

BACKGROUND

Earth-working machines, such as, excavators, wheel loaders, hydraulic mining shovels, cable shovels, bucket wheels, bulldozers, and draglines, for example, are generally used for digging or ripping into the earth or rock and/or moving loosened work material from one place to another at a worksite. These earth-working machines include various earth-working implements, such as forks, a bucket, or a blade, for excavating or moving the work material. Such implements can be subjected to extreme wear from the abrasion and impacts experienced during the earth-working applications.

To protect these implements against wear, and thereby prolong the useful life of the implements, various ground engaging tools, such as teeth, edge protectors, and other wear members, can be provided to the earth-working implements in the areas where the most damaging abrasions and impacts occur. These ground engaging tools are removably attached to the implements using customized retainer systems, so that worn or damaged ground engaging tools can be readily removed and replaced with new ground engaging tools.

Many removable ground engaging tool systems have been proposed and used for earth-working implements. One example of a wear assembly for excavating equipment is disclosed in U.S. Pat. No. 7,882,649 to Carpenter et al. The disclosed wear assembly includes a wear member and a base each with upper and lower stabilizing surfaces that are offset and at overlapping depths to reduce the overall depth of the assembly while maintaining high strength and a stable coupling. A nose and socket each includes a generally triangular-shaped front stabilizing end to provide a highly stable front connection between the nose and wear member for both vertical and side loading. A lock is movable between hold and release positions to accommodate replacing of the wear member when needed, and secured to the wear member for shipping and storage purposes.

A block handler is a specific type of wheel loader for moving or breaking out large blocks of stone or other material in a quarry, mining, or construction environment. The block handler is typically a front loader configured in a special arrangement to be able to handle the heavy weight of the blocks, such as by having an increased counterweight or high pressure hydraulics. A variety of attachments may be used to handle the stone such as a breaker tine or forks.

The block handler uses a breaker tine for prying loose large stone blocks. The breaker tine is built with an extra thick tine to handle a variety of materials in this demanding application. However, the tip of the breaker tine is prone to wear during use from breaking out and moving heavy stone blocks and other materials. Repair and servicing of existing breaker tines is cumbersome, as it requires the burning of the welds of the tine attached to the main frame. This adds the risk of additional weld stresses and decreases the predicted service life of the breaker tine. Additionally, such repairs may be difficult to perform at customer sites, due to remote locations or accessibility of repair equipment.

Accordingly, there is a need for improved ground engaging tool systems that include on-site replaceable breaker tines. Various aspects of the disclosure may solve one or more of these problems and/or disadvantages.

SUMMARY

In one aspect, the disclosure describes a replaceable ground engaging tool system for a breaker tine. The system includes a back frame assembly, a breaker tine coupled to the back frame assembly, the breaker tine comprising a front elongated portion, a rear elongated portion extending in a direction substantially perpendicular to the front elongated portion, a nose portion extending from the front elongated portion at an opposite end from the rear elongated portion, wherein a first side of the nose portion has a frustoconically shaped first pin on an exterior surface, and a second side of the nose portion has a frustoconically shaped second pin on an exterior surface opposite the first pin, a replaceable ground engaging tool coupled to the nose portion of the breaker tine, comprising a front end, a rear end, a top surface, a bottom surface, a first side opposite a second side, and a nose portion receiving cavity on an interior side.

In another aspect, the disclosure describes a breaker tine, comprising a front elongated portion, a rear elongated portion extending in a direction substantially perpendicular to the front elongated portion, a nose portion extending from the front elongated portion at an opposite end from the rear elongated portion, wherein a first side of the nose portion has a frustoconically shaped first pin on an exterior surface, and a second side of the nose portion has a frustoconically shaped second pin on an exterior surface of the nose portion of the breaker tine.

In yet another aspect, the disclosure describes a pin, comprising a first end, a second end opposite the first end, wherein the second end is frustoconically shaped, and a bolt receiving cavity formed in the second end and substantially centered on a longitudinal axis of the pin, wherein the bolt receiving cavity is threaded on an inside surface, and a top end of the bolt receiving cavity has a bolt head receiving portion.

It is contemplated that in certain aspects the disclosure describes a ground engaging tool system, comprising a back frame assembly, a breaker tine coupled to the back frame assembly, the breaker tine comprising a front elongated portion, a rear elongated portion extending in a direction substantially perpendicular to the front elongated portion, a nose portion extending from the front elongated portion at an opposite end from the rear elongated portion, a first plate receiving cavity formed in a first side of the nose portion, a second plate receiving cavity formed in a second side of the nose portion, wherein the first plate receiving cavity is opposite the second plate receiving cavity but do not communicate or connect with each other, a first plate comprising a frustoconically shaped first knob, wherein the first plate is configured to fit into the first plate receiving cavity, a replaceable ground engaging tool coupled to the nose portion of the breaker tine, comprising a front end, a rear end, a top surface, a bottom surface, a first side opposite a second side, and a nose portion receiving cavity on an interior side.

In certain aspects, the disclosure describes a replaceable ground engaging tool, comprising a front end, a rear end, a top surface, a bottom surface, a first side opposite a second side, a nose portion receiving cavity on an interior side, and a bulge extending outward from an exterior surface of the first side of the ground engaging tool, wherein a lock opening extends through the bulge, wherein a width of the front end of the ground engaging tool extending from the first side to the second side is greater than 1.5 times of a height of the rear end of the ground engaging tool extending from the top surface to the bottom surface of the ground engaging tool.

In another aspect, the disclosure describes a plate, comprising a bottom portion, a top portion, a frustoconically shaped knob located on an exterior surface, a seating portion located between the top portion and the bottom portion, wherein the top portion is thicker than the bottom portion in a direction parallel to a longitudinal axis of the knob.

Further and alternative aspects and features of the disclosed principles will be appreciated from the following detailed description and the accompanying drawings. As will be appreciated, the systems and methods disclosed herein are capable of being carried out in other and different aspects, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
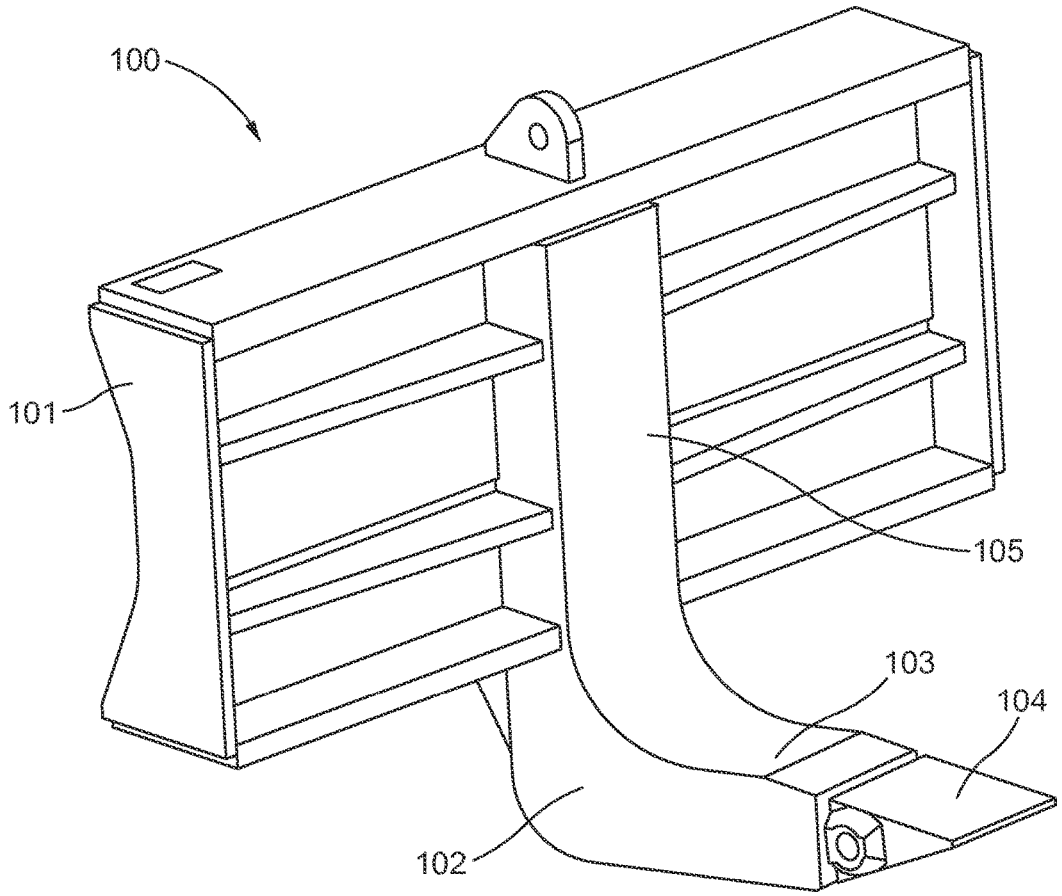
FIG. 1 illustrates a perspective view of a ground engaging tool system according to an aspect of the disclosure.

Now referring to the drawings, wherein like reference numbers refer to like elements, there is illustrated a ground engaging tool system 100 with a frame 101, a tine 102, and a ground engaging tool 104. The ground engaging tool system 100 is configured to be attached to a machine (not shown). The machine can be an "over-the-road" vehicle such as a truck or may be any other type of machine that performs some type of operation associated with an industry such as mining, construction, farming, transportation, or any other industry known in the art. For example, the machine may be an off-highway truck, earth-moving machine, such as a block handler, front loader, forklift, or the like. The ground engaging tool system 100 may be any type of assembly that includes tines, such as a breaker tine assembly or a forklift assembly. The tine 102 can be any type of tine, such as a breaker tine or a forklift tine. The ground engaging tool system 100 may have more than one tine 102, such as in a forklift configuration, for example, that may have two tines 102.

An exemplary aspect of the disclosure provides a mechanically attached ground engaging tool (GET) 104 (FIG. 1) for a block handler breaker tine. The ground engaging tool may be a replaceable tip or wear resistant cap for a tine which can be easy to remove and replace in the field. The use of such a ground engaging tool increases the service life of the tines, and provides for the easy replacement of parts that may exhibit increased wear.

Any dimensions recited herein are, of course, by way of illustration only. In other aspects, other dimensions may be used, and the dimensions can be varied in any fashion as appropriate to the application.

FIG. 1 illustrates a perspective view of a ground engaging tool system 100 according to an aspect of the disclosure. In the aspect shown in FIG. 1, the ground engaging tool system 100 with the frame 101, the tine 102, and the ground engaging tool 104 is shown. The tine 102 may be coupled to the frame 101, where the tine 102 may have an elongated body with a front elongated portion 103 and a rear elongated portion 105. In one aspect of the disclosure, the front elongated portion 103 can extend from the rear elongated portion 105 in a direction substantially perpendicular to the rear elongated portion 105, and likewise the rear elongated portion 105 may extend in a direction substantially perpendicular to the front elongated portion 103.

Figure 2:
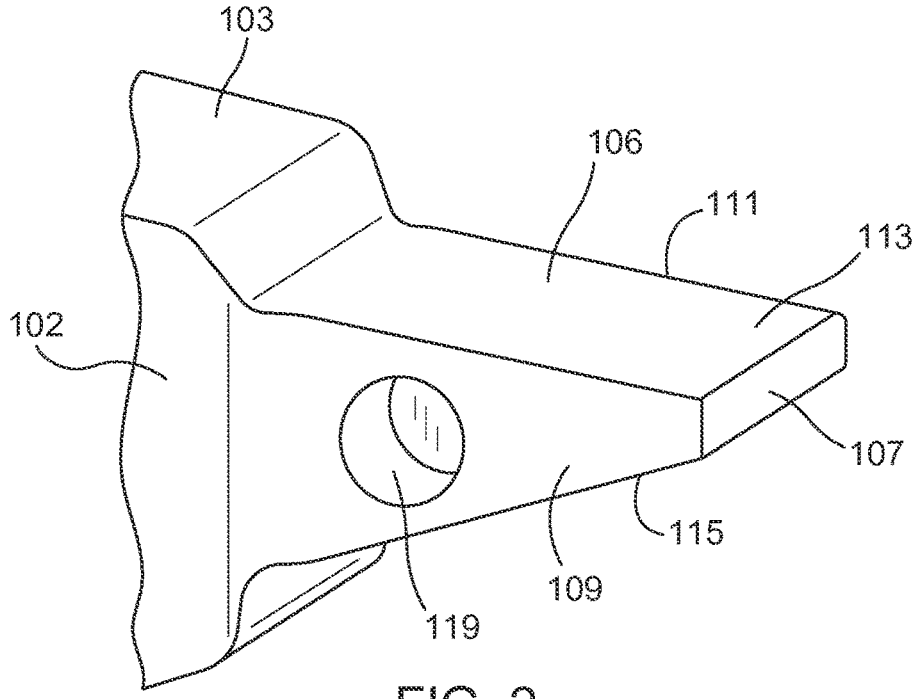
FIG. 2 illustrates a perspective view of a portion of a tine according to an aspect of the disclosure.

FIG. 2 illustrates a perspective view of a portion of a tine according to an aspect of the disclosure. Front elongated portion 103 may have a nose portion 106 located at an opposite end from the rear elongated portion 105. The nose portion 106 may have a first side 109 opposite a second side 111 and a top surface 113 opposite a bottom surface 115, where the top surface 113 and the bottom surface 115 converge towards a tip 107 of the nose portion 106 in a direction opposite from the rear elongated portion 105.

In certain aspects, a first pin receiving cavity 119 may be formed in the first side 109 of the nose portion 106, and a second pin receiving cavity 139 may be formed in the second side 111 of the nose portion 106. As seen in FIG. 2, it is contemplated that in some aspects the first pin receiving cavity 119 may extend only partially into the first side 109 of the nose portion 106, and may not extend through the nose portion 106 to the second side 111. In a similar fashion, in some aspects the second pin receiving cavity 139 (FIG. 3) may not extend through the nose portion 106 to the first side 109. In an aspect, the first pin receiving cavity 119 and the second pin receiving cavity 139 may be cylindrically shaped.

Figure 3:
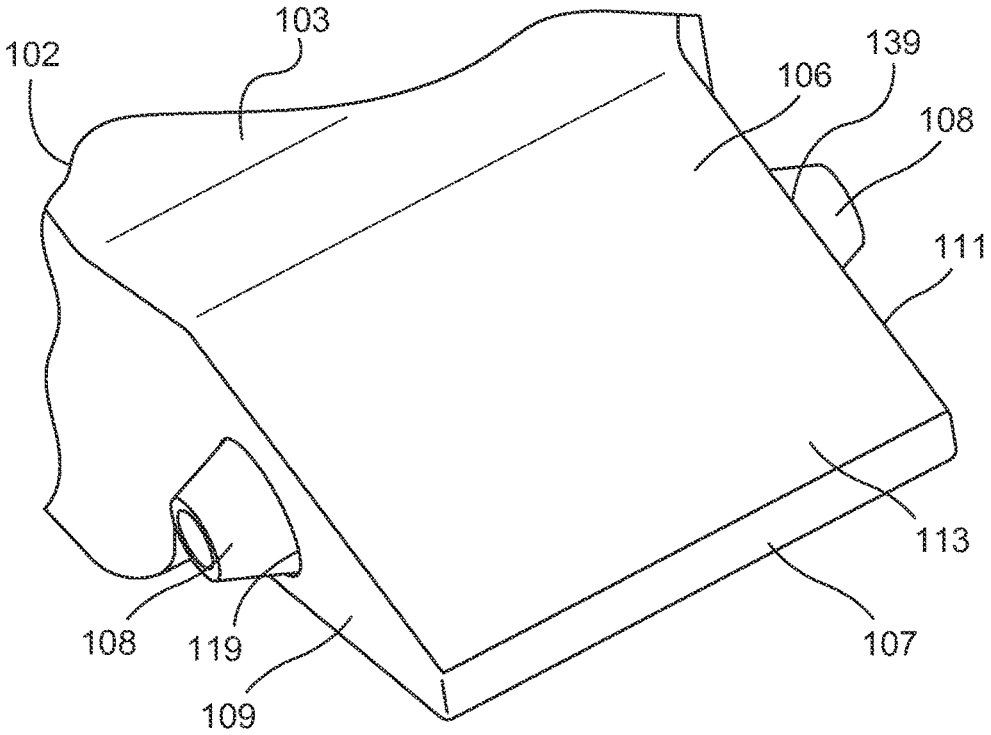
FIG. 3 illustrates the breaker tine of FIG. 2 having pins in the pin receiving cavities according to an aspect of the disclosure.

FIG. 3 illustrates the tine of FIG. 2 having pins in the pin receiving cavities according to an aspect of the disclosure. In certain aspects, the first pin receiving cavity 119 on the first side 109 of the nose portion 106 can be located opposite the second pin receiving cavity 139 on the second side 111 of the nose portion 106 such that a longitudinal axis of the first pin receiving cavity 119 is aligned with a longitudinal axis of the second pin receiving cavity 139. In one aspect the longitudinal axis of the first and second pin receiving cavities do not communicate with or contact each other. In the aspect shown in FIG. 3, two pins 108 and two pin receiving cavities 119 and 139 are used. However, in other aspects any number of pins 108 and pin receiving cavities 119 and 139 may be used, such as, aspects with one pin and one receiving cavity, or aspects with four pins and four receiving cavities, for example. As used herein, the term pin may refer to a pin or a knob.

Pins 108 may be inserted into the pin receiving cavities 119 and 139, where the pins 108 may be held in place by any suitable method such as by gluing or using screw threads. It is also contemplated that in some aspects the pins 108 may be held in place by friction between an exterior surface of the pins 108 and an interior surface of the pin receiving cavities 119 and 139.

Figure 4:
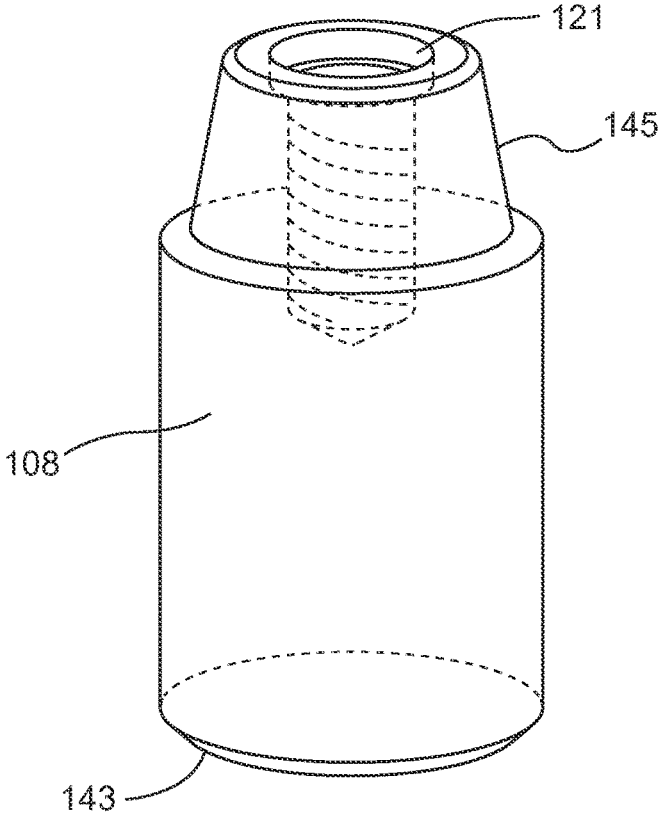
FIG. 4 illustrates a perspective view of the pin shown in FIG. 3 having a cavity according to an aspect of the disclosure.

FIG. 4 illustrates a perspective view of the pin shown in FIG. 3 having a cavity according to an aspect of the disclosure. The pin 108 may have a first end 143 and a second end 145, wherein the second end 145 may be frustoconically shaped. A bolt receiving cavity 121 can be formed in the second end 145, where the bolt receiving cavity 121 can be substantially centered on a longitudinal axis of the elongated body of the pin 108. A bolt (not shown) may be inserted in the bolt receiving cavity 121, where the bolt receiving cavity 121 may be threaded on an inside surface, such that the bolt may be screwed into the bolt receiving cavity 121. In an aspect, the bolt can be inserted into the bolt receiving cavity 121 when the pin 108 is disposed in a pin receiving cavity, to aid in extracting the pin from the pin receiving cavity. A head of the bolt, when fully inserted, may rest on a bolt head receiving portion 142 (FIG. 5) located a top end of the bolt receiving cavity 121. To remove the pin 108 from the pin receiving cavity, a wrench, pliers, or other tools may be used to grip and pull on the bolt to extract the pin 108.

Figure 5:
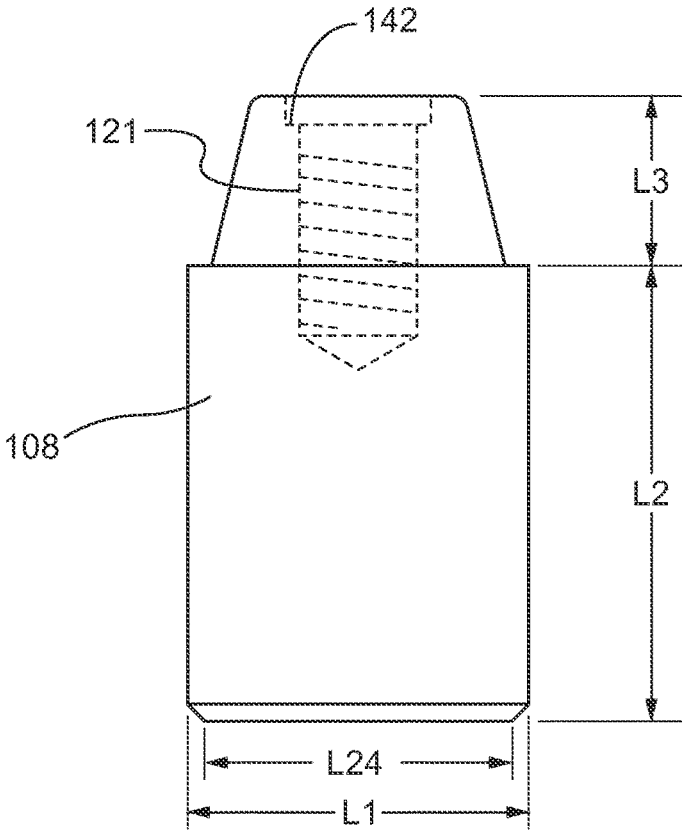
FIG. 5 illustrates a side view of the pin according to an aspect of the disclosure.

FIG. 5 illustrates a side view of the pin according to an aspect of the disclosure. In an aspect of the disclosure shown in FIG. 5, the outer width (L1) of the pin 108 may be about 50-70 mm, the height of the portion of the pin from the base of the pin to the start of the conical section (L2) may be about 70-90 mm, the height of the conical section (L3) may be about 20-40 mm, and the width (L24) may be about 46-66 mm. For example, the width (L1) of the pin 108 may be 60 mm, the height of the portion of the pin from the base of the pin to the start of the conical section (L2) may be 80 mm, the height of the conical section (L3) may be 30 mm, and the width (L24) may be 56 mm.

Figure 6:
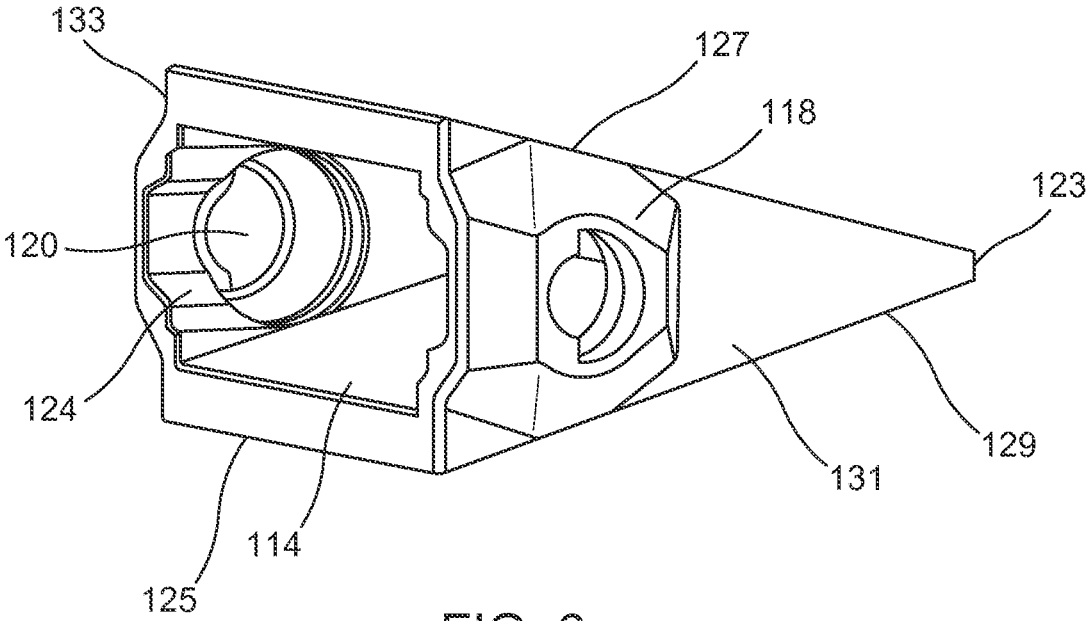
FIG. 6 illustrates a rear perspective view of a ground engaging tool according to an aspect of the disclosure.
Figure 7:
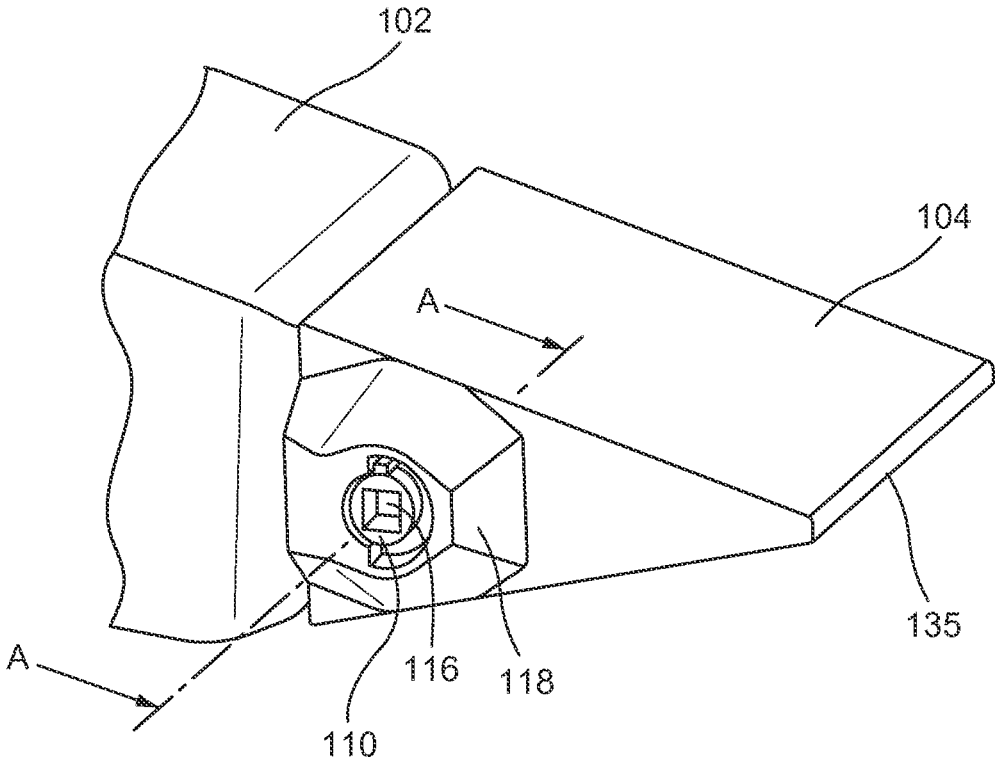
FIG. 7 illustrates a perspective view of a portion of a tine and the ground engaging tool shown in FIG. 6 according to an aspect of the disclosure.
Figure 20:
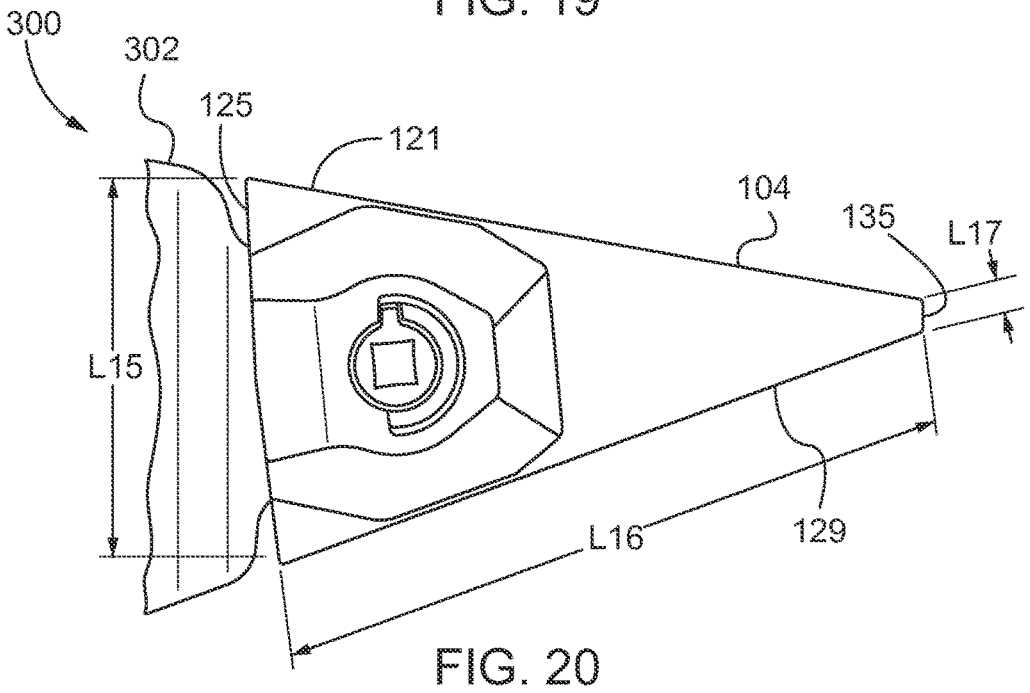
FIG. 20 illustrates a side view of the tine shown in FIG. 16 with the ground engaging tool shown in FIG. 6 according to an aspect of the disclosure.
Figure 21:
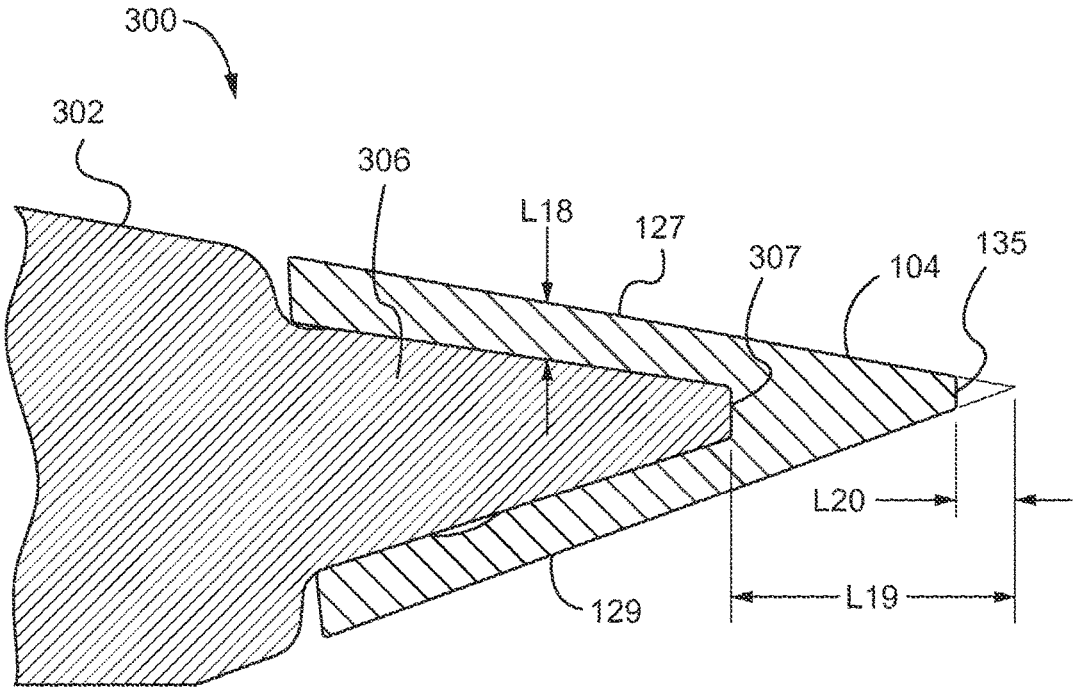
FIG. 21 illustrates a cross-sectional view taken along line C-C of FIG. 19 according to an aspect of the disclosure.

FIG. 6 illustrates a rear perspective view of a ground engaging tool according to an aspect of the disclosure. The ground engaging tool 104 may have a front end 123 opposite a rear end 125, a top surface 127 opposite a bottom surface 129, and a first side 131 opposite a second side 133. It is contemplated that ground engaging tool 104 can have a ground engaging surface on an exterior side, and a nose portion receiving cavity 114 on an interior side. In an aspect, the ground engaging surface may be the tip 135 (FIG. 7). A width of the ground engaging tool 104 extending from the first side 131 to the second side 133 may be greater than a height of the rear end 125 extending from the top surface 127 to the bottom surface 129 of the ground engaging tool 104. In an exemplary aspect, as shown in FIGS. 20-21, the width (L13) of the tip 135 of the ground engaging tool 104 extending from the first side 131 to the second side 133 may be greater than 1.5 times of the height (L15) of the rear end 125 extending from the top surface 127 to the bottom surface 129 of the ground engaging tool 104.

Figure 10:
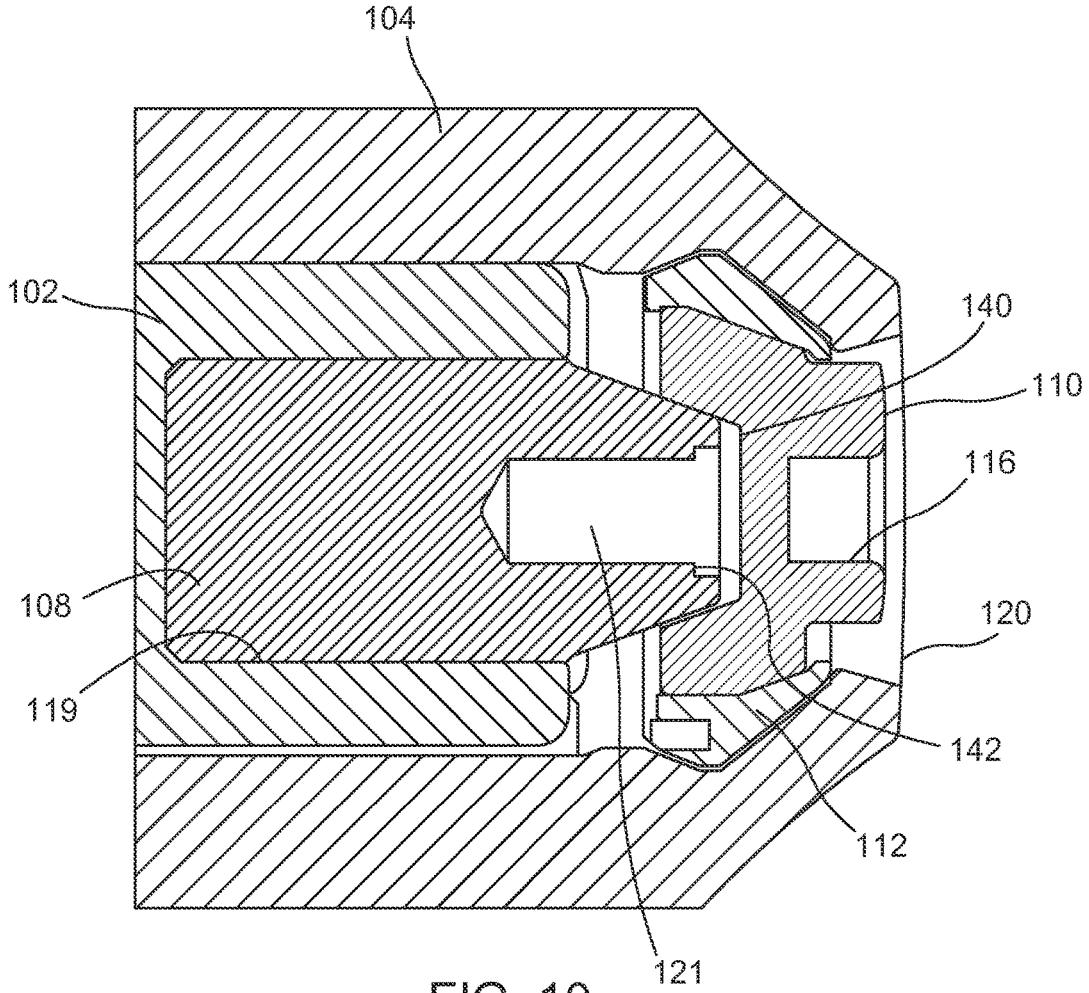
FIG. 10 illustrates a cross-sectional view taken along line A-A of FIG. 7 according to an aspect of the disclosure.

Returning to FIG. 6, a bulge 118 may extend outwardly from an exterior surface of the first side 131 of the ground engaging tool 104. A lock opening 120 may extend through the bulge 118, where the bulge 118 may be capable of receiving a lock 110 (FIG. 7). In some aspects, the lock opening 120 and a receiving slot 124 may be formed in an interior side of a side wall of the ground engaging tool 104, where the lock opening 120 may extend through the bulge 118 and the receiving slot 124. The receiving slot 124 can be recessed from a surface of the side wall and can extend between the rear end 125 of the ground engaging tool 104 to the lock opening 120. The receiving slot 124 may be capable of receiving the pin 108 when the ground engaging tool 104 is slid onto the nose portion 106 of the tine 102, where the pin 108 is then inserted into an indent 140 of the lock 110 (as seen in FIG. 10). In some aspects, a second bulge may be disposed on the second side 133.

FIG. 7 illustrates a perspective view of a portion of a tine and the ground engaging tool shown in FIG. 6 according to an aspect of the disclosure. In FIG. 7, the ground engaging tool 104 is shown coupled to the tine 102 by the lock 110. In certain aspects, the lock 110 may be capable of being rotatably positioned in the lock opening 120 to rotate between an unlocked position and a locked position. A locking indent 116 is shown in the top of lock 110 that may be capable of receiving a tool (e.g. a ratchet, etc.) to rotate the lock 110 to a closed or locked position.

Figure 8:
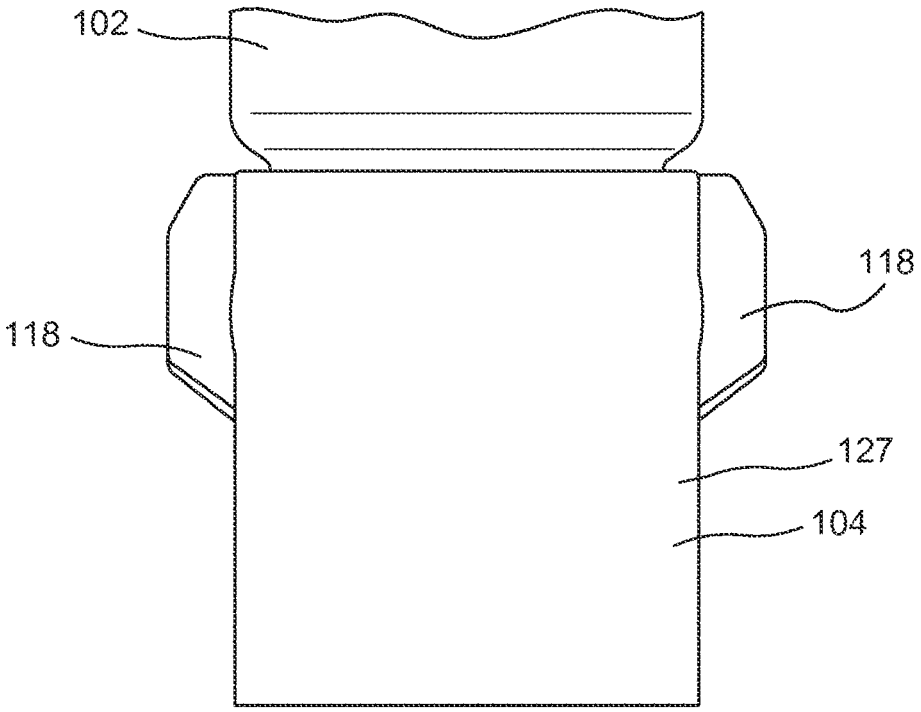
FIG. 8 illustrates a top view of a portion of a tine and a ground engaging tool shown in FIG. 6 according to an aspect of the disclosure.

FIG. 8 illustrates a top view of a portion of a tine and a ground engaging tool shown in FIG. 6 according to an aspect of the disclosure. In the aspect shown in FIG. 8, the ground engaging tool 104 is shown coupled to the tine 102.

Figure 9:
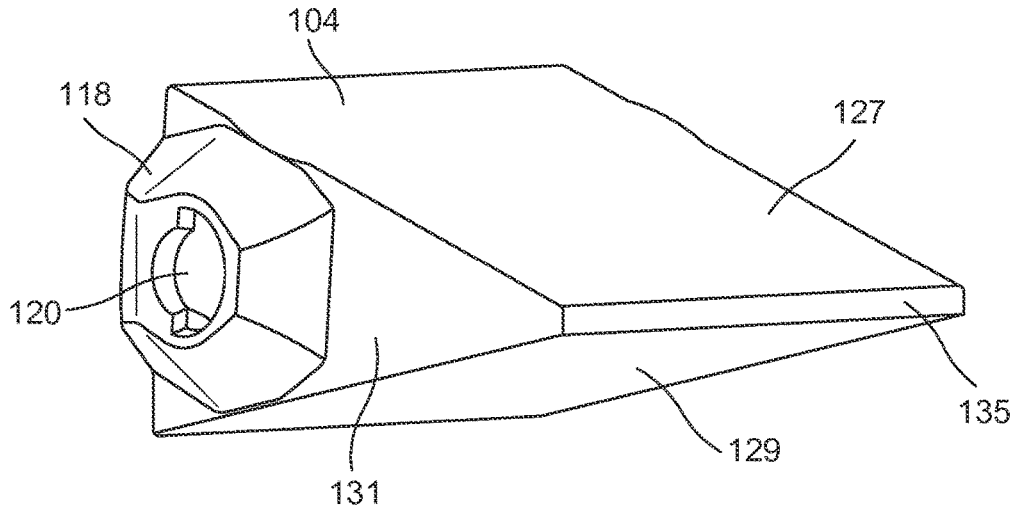
FIG. 9 illustrates a front perspective view of a ground engaging tool shown in FIG. 6 according to an aspect of the disclosure.

FIG. 9 illustrates a front perspective view of a ground engaging tool shown in FIG. 6 according to an aspect of the disclosure. In the aspect shown in FIG. 9, the top surface 127 is shown opposite the bottom surface 129. In certain aspects, the top surface 127 may converge towards the bottom surface 129 at the tip 135. FIG. 9 also illustrates a front perspective view of the bulge 118 with lock opening 120 shown in the first side 131.

FIG. 10 illustrates a cross-sectional view taken along line A-A of FIG. 7 according to an aspect of the disclosure. In FIG. 10, the pin 108 is shown disposed in the pin receiving cavity 119 of tine 102. The lock 110 is shown in lock opening 120 of the ground engaging tool 104, and disposed on the pin 108. An indent 140 can be located in the bottom of the lock 110 to receive the pin 108. In an aspect, locking indent 116 may be capable of receiving a tool (e.g. a ratchet, etc.) capable of rotating the lock 110 around the pin 108. The lock 110 may be rotated so that the entrance to the indent 140 is blocked and the pin 108 cannot slide out of the indent 140. In this position, lock 110 is in a locking position, and the retention of the pin 108 in the indent 140 of the lock 110 retains the ground engaging tool 104 to the nose portion 106 of the tine 102.

In one exemplary aspect, lock 110 and retainer bushing 112 may be configured to seat within an inner surface of lock opening 120 in a manner allowing lock 110 to rotate at least partially around a lock rotation axis relative to retainer bushing 112. As the ground engaging tool 104 is slid onto the nose portion 106, the pin 108 is inserted into the indent 140 of the lock 110. As best shown in FIG. 10, retainer bushing 112 may seat directly against inner surface of lock opening 120, and lock 110 may seat against an inner surface of retainer bushing 112. The retainer bushing 112 may be made of rubber or plastic, and the lock 110 may be made of a metal, such as steel. Retainer bushing 112 may be a C-shaped skirt that extends around the lock 110. In some aspects, the skirt may extend only partway around the lock 110. Retainer bushing 112 may be configured to mate with the inner surface of lock opening 120. For example, retainer bushing 112 may include an outer surface with a frustoconical portion configured to mate with a corresponding frustoconical portion of the inner surface in lock opening 120. Lock opening 120 may be configured such that, when retainer bushing 112 is seated in lock opening 120, rotation of retainer bushing 112 with respect to the lock rotation axis is substantially prevented.

Figure 11:
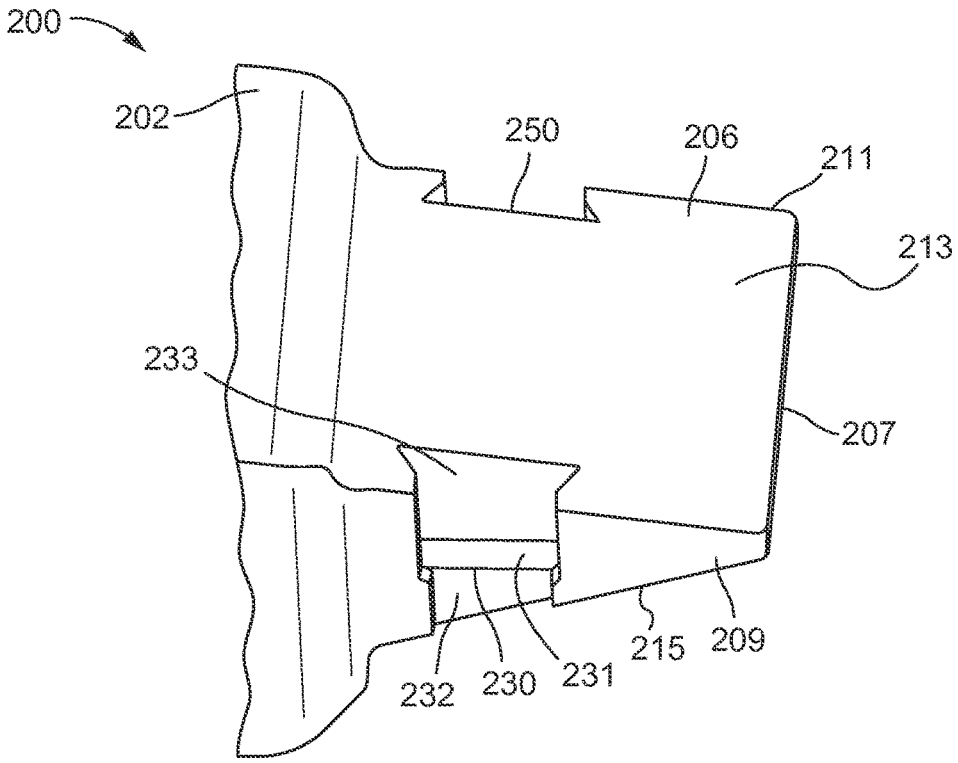
FIG. 11 illustrates a ground engaging tool system with plate receiving cavities according to an aspect of the disclosure.

FIG. 11 illustrates a ground engaging tool system 200 with plate receiving cavities 230 and 250 according to an aspect of the disclosure. FIG. 11 illustrates an aspect with a plate configuration, where the nose portion 206 of the tine 202 is capable of receiving plates 208 and 212 (FIG. 12) instead of pins 108 as in other aspects of the disclosure. In some aspects, the nose portion 106 of the tine 202 includes a plate receiving cavity 230 formed in a side of the nose portion 206. The plate receiving cavity 230 may extend from the top surface 213 to the bottom surface 215 of the nose portion 206. It is contemplated that the plate receiving cavity 230 may be a first plate receiving cavity, and be located opposite from a second plate receiving cavity 250, where the first plate receiving cavity 230 is located on a first side 209, and the second plate receiving cavity 250 is located on a second side 211.

The plate receiving cavity 230 may include a top indent portion 233, a bottom indent portion 232, and a ledge 231 parallel to the top surface 213 of the nose portion 206. In some aspects, the ledge 231 may be formed between the top indent portion 233 and the bottom indent portion 232, such that the top indent portion 233 extends further into the first side 209 of the nose portion 206 in a direction towards the second side 211 than the bottom indent portion 232. Likewise, the bottom indent portion 232 of the plate receiving cavity 230 may then be shallower than the top indent portion 233 in a direction towards the second side 211. In an aspect, the top indent portion 233 of the plate receiving cavity 230 may be wider than the bottom indent portion 232 in a direction towards the tip 207 of the nose portion 206.

Figure 12:
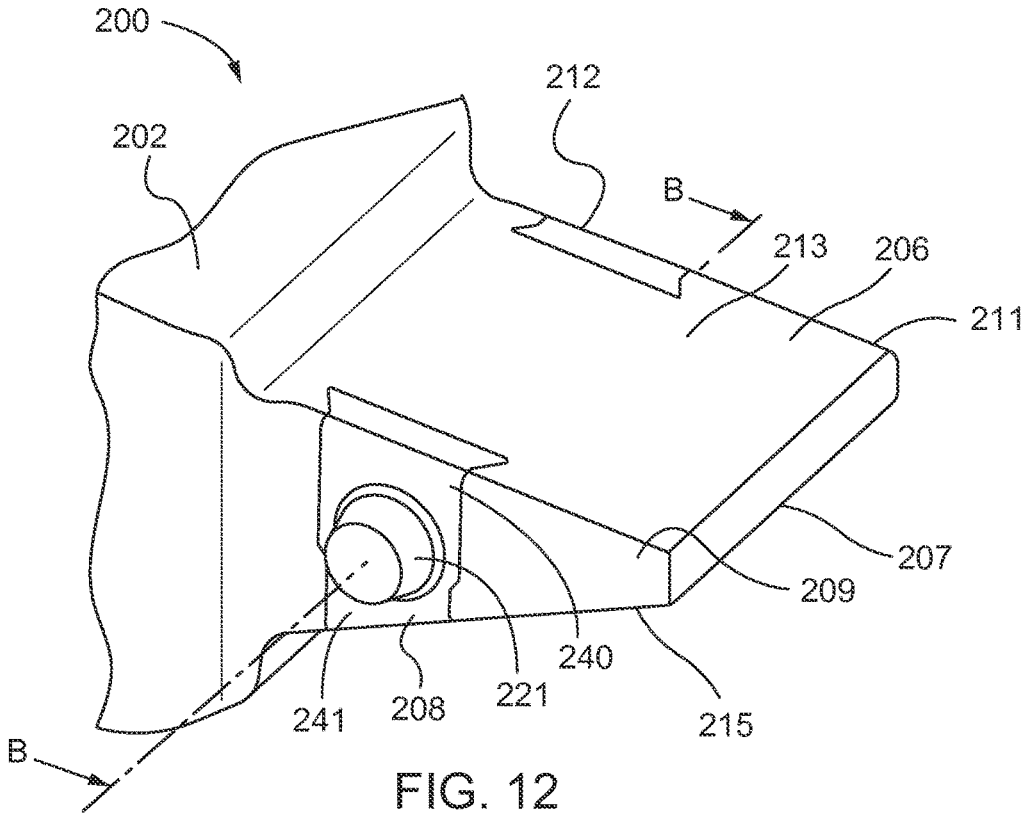
FIG. 12 illustrates plates disposed in the plate receiving cavities shown in FIG. 11 according to an aspect of the disclosure.

FIG. 12 illustrates plates disposed in the plate receiving cavities shown in FIG. 11 according to an aspect of the disclosure. A first plate 208 may be configured to fit in the first plate receiving cavity 230, and a second plate 212 may be configured to fit in the second plate receiving cavity 250. The plates 208 and 212 may further include a top portion 240, a bottom portion 241, a seating portion 242 (FIG. 14), and a knob 221. The knob 221 may be a frustoconical shape, and function similarly to the top end of a pin 108, where the knob 221 may be capable of engaging the ground engaging tool 104 and the lock 110. Other shapes of the knob 221 may also be used. In an aspect, the bottom portion 241 of the first plate 208 may be narrower than the top portion 240 in a direction parallel to the first side 209 of the nose portion 206. As used herein, the term knob may refer to a knob or a pin.

Furthermore, as shown in FIG. 12, the top portion 240 of the first plate 208 may be flush with the side wall 209 and top surface 213 of the nose portion 206 when the first plate 208 is seated in the plate receiving cavity 230. Additionally, the bottom portion 241 may be flush with the bottom surface 215, when the first plate 208 is seated in the plate receiving cavity 230. Likewise, the second plate 212 may be flush with the side wall 211, the top surface 213, and the bottom surface 215 when seated in plate receiving cavity 250. In the aspect shown in FIG. 12, two plates 208 and 212, and two plate receiving cavities 230 and 250 are used. However, in other aspects any number of plates 208 and 212 and plate receiving cavities 230 and 250 may be used, such as, aspects with one plate and one plate receiving cavity, or aspects with four plates and four plate receiving cavities, for example.

Figure 13:
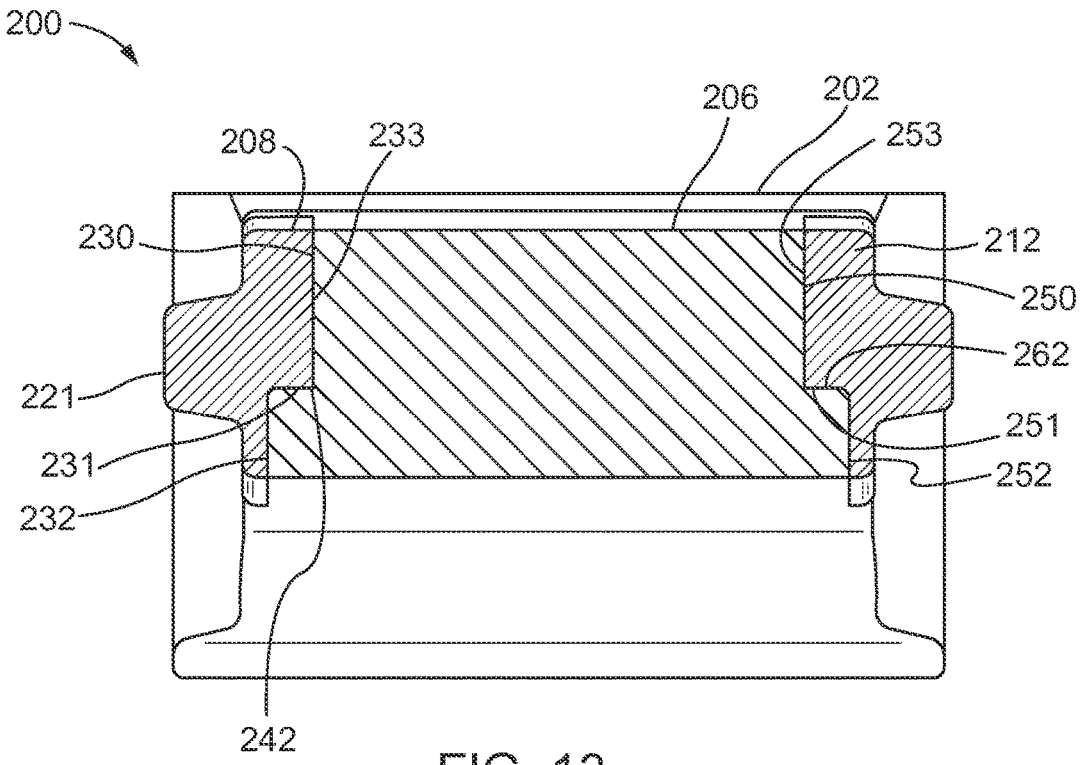
FIG. 13 illustrates a cross-sectional view taken along line B-B of FIG. 12 according to an aspect of the disclosure.

FIG. 13 illustrates a cross-sectional view taken along line B-B of FIG. 12 according to an aspect of the disclosure. In FIG. 13, the first plate 208 is shown seated in the first plate receiving cavity 230, and the second plate 212 is shown seated in the second plate receiving cavity 250. The first plate 208 is shown with seating portion 242 disposed on ledge 231 of the first plate receiving cavity 230. As such, the ledge 231 may be formed between the top indent portion 233 and the bottom indent portion 232, so that the top indent portion 233 extends further into the nose portion 206 in a direction towards the second plate receiving cavity 250 than the bottom indent portion 232. Similarly, seating portion 262 of the second plate 212 is shown disposed on ledge 251 of the second receiving cavity 250. As such, the ledge 251 may be formed between the top indent portion 253 and the bottom indent portion 252, so that the top indent portion 253 extends further into the nose portion 206 in a direction towards the first plate receiving cavity 230 than the bottom indent portion 252.

Figure 14:
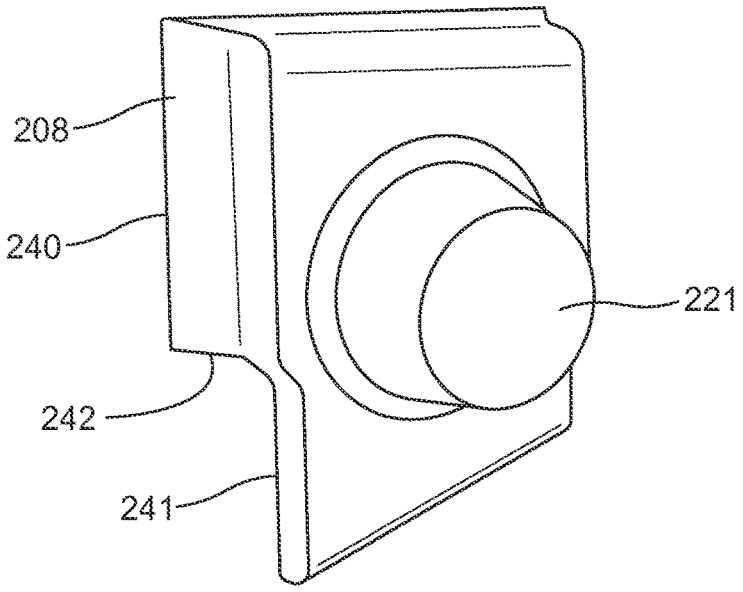
FIG. 14 illustrates a perspective view of a first plate according to an aspect of the disclosure.

FIG. 14 illustrates a perspective view of a first plate according to an aspect of the disclosure. In certain aspects, the plate 208 may include a knob 221. The knob 221 may be frustoconically shaped and may be capable of engaging the ground engaging tool 104 and the lock 110 similar to the pin 108 as described above. The receiving slot 124 may be capable of receiving the knob 221 when the ground engaging tool 104 is slid onto the nose portion 206, where the knob 221 is then inserted into the indent 140 of the lock 110. In the aspect of FIG. 14, the first plate 208 is shown with the seating portion 242 disposed between the top portion 240 and the bottom portion 241 of the first plate 208, such that the top portion 240 is thicker than the bottom portion 241. In other aspects, other plate configurations and thicknesses may be used.

Figure 15:
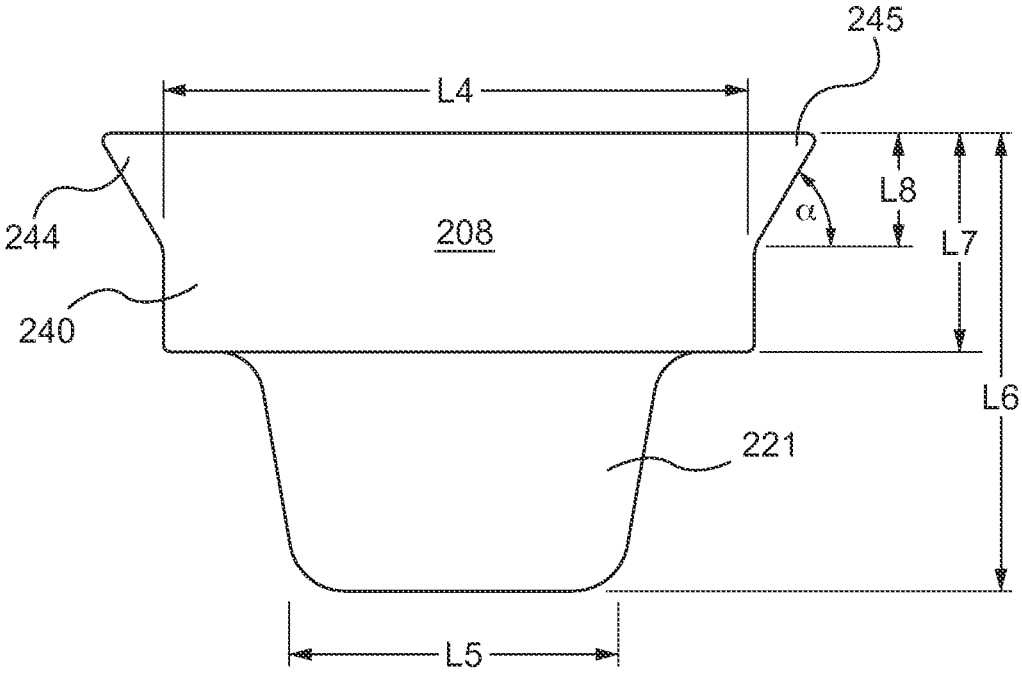
FIG. 15 illustrates a top down view of the first plate shown in FIG. 14 according to an aspect of the disclosure.

FIG. 15 illustrates a top down view of the first plate shown in FIG. 14 according to an aspect of the disclosure. The length of the top portion 240 at the portion near the knob 221 (L4) may be about 60-90 mm, and the width of the knob 221 (L5) may be about 30-50 mm. In an aspect, the maximum thickness of the first plate 208 (L6) may be about 45-65 mm, and the thickness of the top portion 240 (L7) may be about 20-40 mm. The plate 208 may have a first tapered projection 244 and a second tapered projection 245, where the height of a tapered projection (L8) may be about 10-20 mm, and where the angle α may be about 40-80 degrees. For example, the length of the top portion 240 at the portion near the knob 221 (L4) may be 74 mm, the width of the knob 221 (L5) may be 40.0 mm, the maximum thickness of the first plate 208 (L6) may be 57.5 mm, the thickness of the top portion 240 (L7) may be 27.5 mm, the height of the tapered projection 245 (L8) may be 14.4 mm, and the angle α may be 60 degrees. An aspect of the disclosure with tapered projections 244 and 245 may be referred to as a dovetail configuration, where a joint may be formed by one or more of the tapered projections 244 and 245 on a plate (208, 212) interlocking with a corresponding plate receiving cavity (230, 250) in the nose portion 206 of the tine 202, as seen in FIG. 12.

Figure 16:
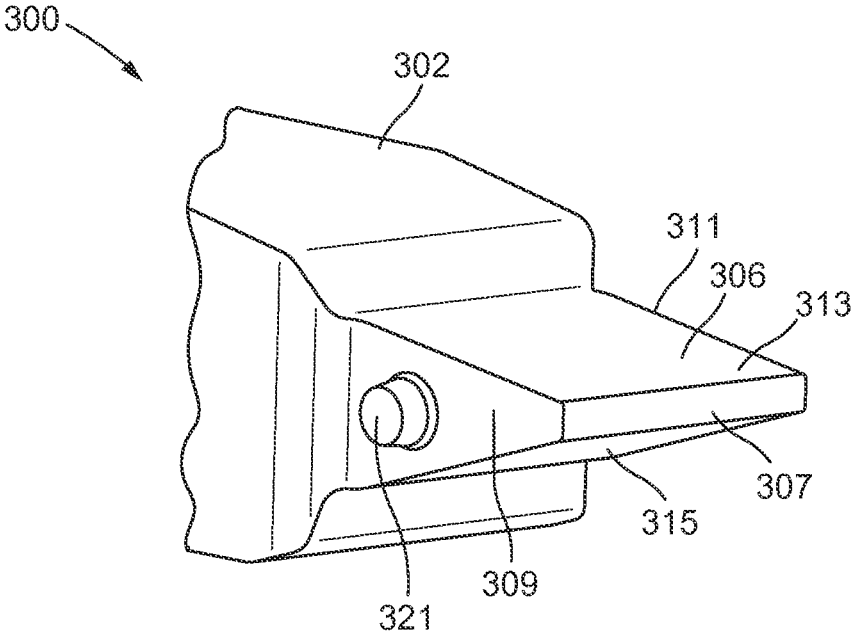
FIG. 16 illustrates a ground engaging tool system with knobs integrated into the tine according to an aspect of the disclosure.

FIG. 16 illustrates a ground engaging tool system 300 with knobs 321 integrated into the tine 302 according to an aspect of the disclosure. The tine 302 may have a nose portion 306 with a first side 309 opposite a second side 311, and a top surface 313 opposite a bottom surface 315. In certain aspects, the top surface 313 and the bottom surface 315 may converge towards a tip 307 of the nose portion 306. Tip 307 can extend in a direction perpendicular to a longitudinal axis of the front elongated portion 103. As seen in FIG. 16, a knob 321 may extend outwardly from the first side 309. It is contemplated that the knobs 321 may be formed as part of the tine 302 as a single piece of material (e.g., formed during casting, etc.). In other aspects, the knobs 321 may be attached to the nose portion 306 by other processes such as welding.

The dimensions recited in FIGS. 18-22 are exemplary and may be directed to a tine 302, but may apply to other aspects, such those seen in FIGS. 1-3 and 7-11 (directed to tine 102), and FIGS. 12-14 (directed to tine 202) as well.

Figure 17:
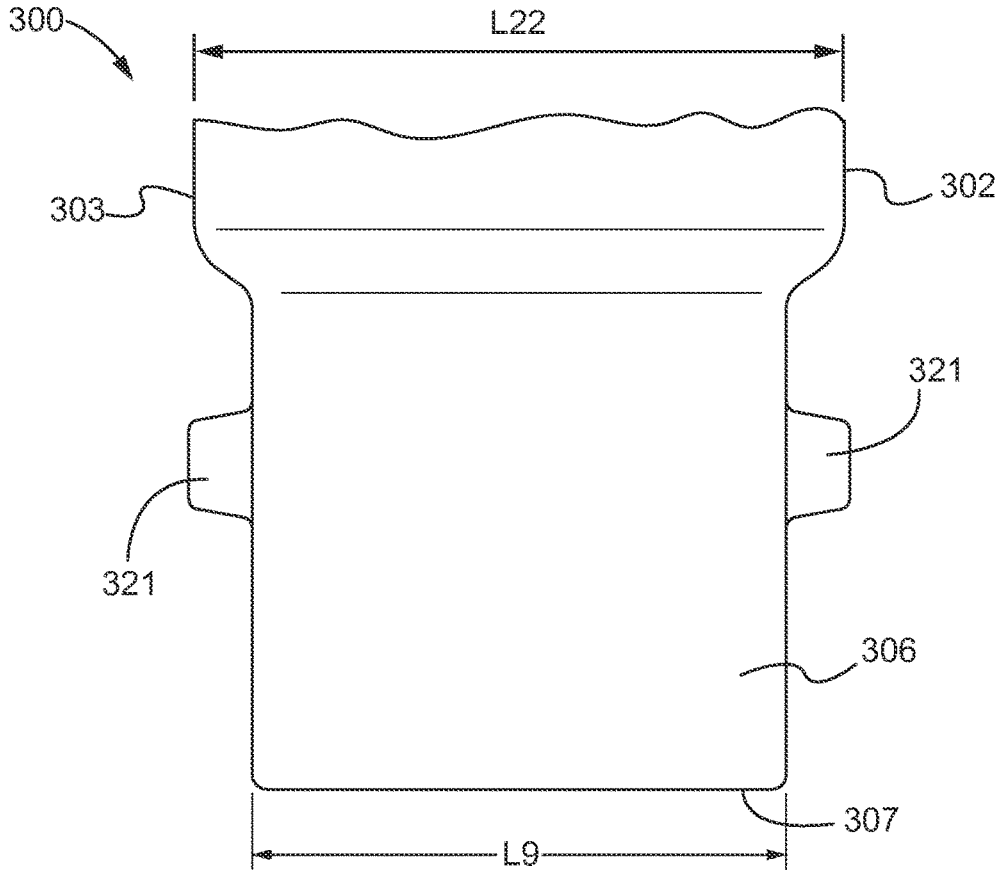
FIG. 17 illustrates a top down view of the tine with knobs shown in FIG. 16 according to an aspect of the disclosure.

FIG. 17 illustrates a top down view of the tine with knobs shown in FIG. 16 according to an aspect of the disclosure. As seen in FIG. 17, a maximum width (L9) of the nose portion 306 in a direction parallel to the tip 307 may be substantially thinner than a minimum width (L22) of the front elongated portion 303 in a direction parallel to the tip 307. In an aspect, the maximum width (L9) of the nose portion 306 may be about 230-260 mm, and the minimum width (L22) of the front elongated portion 303 may be about 280-320 mm. For example, the maximum width (L9) of the nose portion 306 may be about 246 mm, and the minimum width (L22) of the front elongated portion 303 may be about 300 mm.

Figure 18:
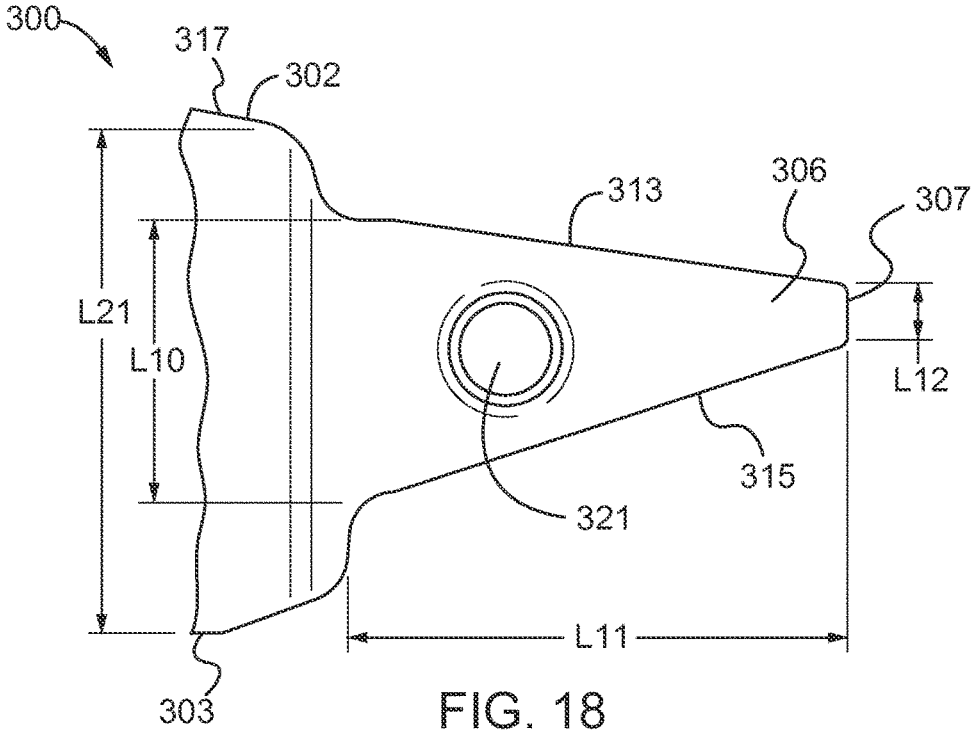
FIG. 18 illustrates a side view of the tine with knobs shown in FIG. 16 according to an aspect of the disclosure.

FIG. 18 illustrates a side view of the tine with knobs shown in FIG. 16 according to an aspect of the disclosure. As seen in FIG. 18, a maximum thickness (L10) of the nose portion 306 in a direction perpendicular to the top surface 313 of the nose portion 306 may be substantially thinner than a minimum thickness (L21) of the front elongated portion 303 of the tine 302 in a direction perpendicular to a top surface 317 of the front elongated portion 303. In an exemplary aspect, the maximum thickness (L10) of the nose portion 306 may be 120 mm. The height of the tip 307 (L12) may be about 20-30 mm, the length of the nose portion 306 (L11) may be about 210-230 mm, and the minimum thickness (L21) of the front elongated portion 303 may be about 190-220 mm. For example, the height of the tip 307 (L12) may be 26 mm, the length of the nose portion 306 (L11) may be 220 mm, and the minimum thickness (L21) of the front elongated portion 303 may be about 210 mm.

Figure 19:
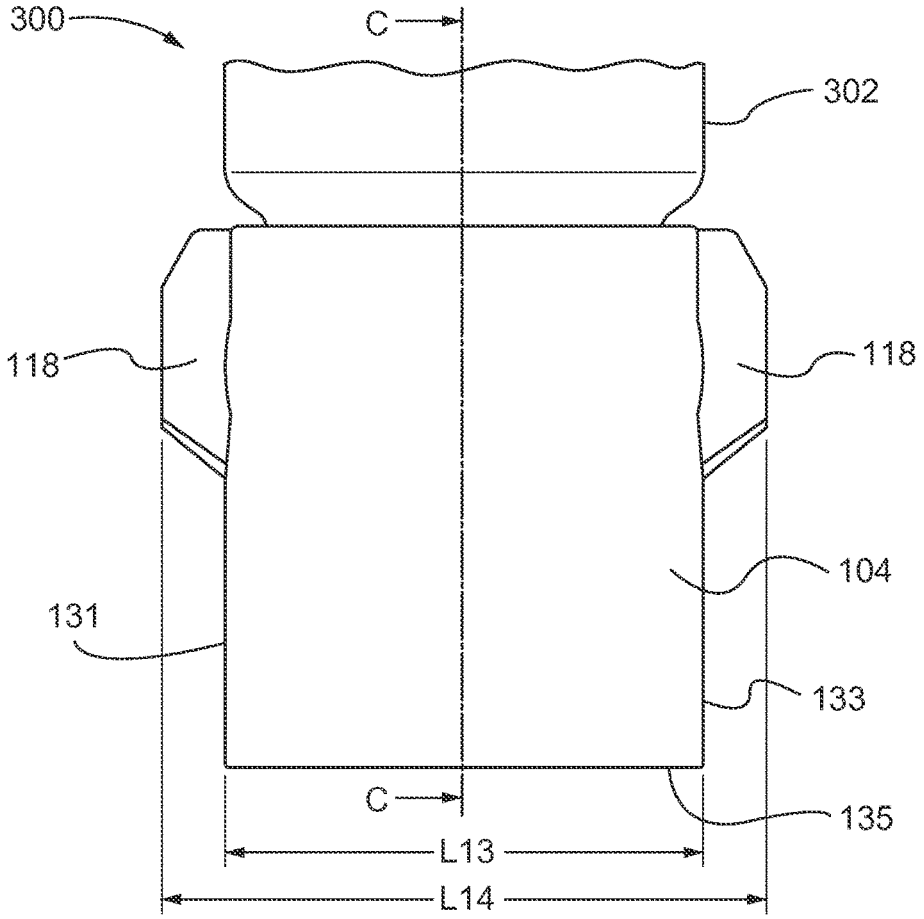
FIG. 19 illustrates a top down view of the tine shown in FIG. 16 with the ground engaging tool shown in FIG. 6 according to an aspect of the disclosure.

FIG. 19 illustrates a top down view of the tine shown in FIG. 16 with the ground engaging tool shown in FIG. 6 according to an aspect of the disclosure. In certain aspects, the width of the tip 135 of the ground engaging tool 104 (L13) may be about 280-320 mm, and the width of the ground engaging tool 104 between the outermost edges of the bulges 118 (L14) may be about 360-400 mm. For example, the width of the tip 135 of the ground engaging tool 104 (L13) may be about 300 mm, and the width of the ground engaging tool 104 between the outermost edges of the bulges 118 (L14) may be about 380 mm. In other aspects, the width of the tip 135 (L13) may be wider than the width L14.

FIG. 20 illustrates a side view of the tine shown in FIG. 16 with the ground engaging tool shown in FIG. 6 according to an aspect of the disclosure. In an aspect, the height of the tip 135 of the ground engaging tool 104 (L17) may be about 10-20 mm, and the length of the bottom side 129 (L16) may be about 320-350 mm. A height of the rear end 125 of the ground engaging tool 104 (L15) may be about 185-205 mm. For example, the height of the tip 135 of the ground engaging tool 104 (L17) may be about 16 mm, the length of the bottom side 129 (L16) may be about 335 mm, and a height of the rear end 125 of the ground engaging tool 104 (L15) may be about 195 mm.

FIG. 21 illustrates a cross-sectional view taken along line C-C of FIG. 19 according to an aspect of the disclosure. The thickness (L18) of the ground engaging tool 104 over the nose portion 306 may be about 20-30 mm. In certain aspects, where the ground engaging tool 104 is coupled to the nose portion 306, the distance (L19) between the tip 307 of the nose portion 306 and a point where the top surface 127 and the bottom surface 129 of the ground engaging tool 104 converge to a point may be about 110-120 mm. In an aspect where the top surface 127 and the bottom surface 129 of the ground engaging tool 104 may converge at the tip 135, the distance shown by L20 may be about 20-40 mm.

For example, in the aspect of FIG. 21, the thickness (L18) of the ground engaging tool 104 over the nose portion 306 may be about 25 mm, the distance (L19) between the tip 307 of the nose portion 306 and a point where the top surface 127 and the bottom surface 129 of the ground engaging tool 104 converge to a point may be about 115 mm. In an exemplary aspect where the top surface 127 and the bottom surface 129 of the ground engaging tool 104 may converge at the tip 135, where the height of the tip 135 may be about 16 mm, the distance shown by L20 may be about 29 mm.

INDUSTRIAL APPLICABILITY

Typically, a breaker tine can be attached to a block handler for moving or breaking out large blocks of stone or other material in a quarry, mining, or construction environment. The block handler may use the breaker tine for prying loose large stone blocks. As an example, a block handler with a breaker tine may be used in a marble quarry environment where slabs of marble are cut from the side of a mountain. In such a case, the slabs are cut in a direction perpendicular to the ground, where the cut may not penetrate completely, leaving the slab slightly attached to the rock face of the mountain. A block handler with a breaker tine then can insert the tip of the breaker tine into the cut, and pry the slab from the mountain. The cut is often only about ½-¾ inches thick, so in such a case the tip of the ground engaging tool of the breaker tine should be thin enough (e.g., at L17 in FIG. 20) to fit into such a cut. Due to the extreme forces involved in such an operation, the ground engaging tool of the breaker tine may be prone to wear or damage. The easily replaceable nature of the ground engaging tool of the disclosure alleviates the need to replace the entire breaker tine structure, when the tip of the breaker tine is worn or damaged. The tines, ground engaging tools, pins, and plates may be made of a metal such as steel, but in other aspects may be made of any material suitable to the application.

To install the ground engaging tool 104 on the nose portion 106 of a tine 102 with pin receiving cavities (119, 139) or plate receiving cavities (230, 250), the pins 108 or plates (208, 212) are first inserted into their respective receiving cavities. In an aspect where the knobs 321 are integral to the tine 302, as seen in FIGS. 17-19, no such insertion of pins or plates may be necessary. The ground engaging tool 104 with locks 110 are then inserted over the nose portion 106 of the tine 102 where the frustoconically shaped ends of the pins 108 or knobs (221, 321) are inserted into the locks 110. The locks 110 may then be turned (e.g., with a ratchet or other suitable tool) to lock the ground engaging tool 104 onto the nose portion 106 of the tine 102. To remove the ground engaging tool 104 from the nose portion 106 of the tine 102, the process is reversed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A ground engaging tool system, comprising:
- a back frame assembly;
- a breaker tine coupled to the back frame assembly, the breaker tine comprising:
  - a front elongated portion;
  - a rear elongated portion extending in a direction substantially perpendicular to the front elongated portion;
  - a nose portion extending from the front elongated portion at an opposite end from the rear elongated portion;
  - a first plate receiving cavity formed in a first side of the nose portion;
  - a second plate receiving cavity formed in a second side of the nose portion;
  - wherein the first plate receiving cavity is opposite the second plate receiving cavity but do not communicate or connect with each other;
- a first plate comprising a frustoconically shaped first knob, wherein the first plate is configured to fit into the first plate receiving cavity;
- a replaceable ground engaging tool coupled to the nose portion of the breaker tine, comprising:
  - a front end;
  - a rear end;
  - a top surface;
  - a bottom surface;
  - a first side opposite a second side; and
  - a nose portion receiving cavity on an interior side.

2. The system of claim 1, wherein the first plate receiving cavity further comprises:
- a bottom indent portion;
- a top indent portion; and
- a ledge parallel to the top surface of the nose portion and disposed between the bottom indent portion and top indent portion.

3. The system of claim 2, wherein the top indent portion is deeper in a direction towards the second plate receiving cavity than the bottom indent portion.

4. The system of claim 3, wherein the top indent portion is wider in a direction towards a tip of the nose portion than the bottom indent portion.

5. The system of claim 1, wherein the first plate further comprises:
- a bottom portion;
- a top portion; and
- a seating portion located between the top portion and the bottom portion.

6. The system of claim 5, wherein the top portion is thicker than the bottom portion in a direction parallel to a longitudinal axis of the first knob, wherein a width of the bottom portion of the first plate is narrower than a width of the top portion of the first plate, wherein the first knob is frustoconically shaped.

7. The system of claim 6, wherein the first plate further comprises:
- a first tapered projection extending outward from a first side of the top portion of the first plate; and
- a second tapered projection extending outward from a second side of the top portion of the first plate opposite the first side.

8. The system of claim 7, further comprising:
- a second plate including a frustoconically shaped second knob, wherein the second plate is configured to fit into the second plate receiving cavity.

9. The system of claim 1, wherein the ground engaging tool further comprises a bulge extending outward from an exterior surface of the first side of the ground engaging tool, wherein a lock opening extends through the bulge to the nose portion receiving cavity, and wherein a width of the front end of the ground engaging tool extending from the first side to the second side is greater than 1.5 times of a height of the rear end of the ground engaging tool extending from the top surface to the bottom surface of the ground engaging tool.

10. The system of claim 9, wherein the ground engaging tool further comprises:
- a receiving slot formed in an interior surface of a first side of the ground engaging tool and extending between the rear end of the ground engaging tool to the lock opening, where the lock opening extends through the bulge, and wherein the receiving slot is configured to receive the first knob.

11. The system of claim 9, wherein the ground engaging tool further comprises:
- a lock coupled to the lock opening, wherein the first knob is capable of being inserted into an indent in a bottom portion of the lock, and wherein the lock further comprises an indent in a top portion of the lock opposite the bottom portion.

12. The system of claim 6, wherein a joint is capable of being formed by one or more tapered projections on the first plate interlocking with the first plate receiving cavity.

13. The system of claim 12, wherein the top portion of the first plate is flush with both the first side and a top surface of the nose portion, and the bottom portion of the first plate is flush with the bottom surface of the nose portion, when the first plate is seated in the first plate receiving cavity.

* * * * *